United States Patent [19]

Jones, Sr.

[11] 3,976,027

[45] Aug. 24, 1976

[54] STRUT DRIVE MECHANISM

[75] Inventor: Ronald O. Jones, Sr., Santa Ana, Calif.

[73] Assignee: Ron Jones Marine Engineering, Inc., Tacoma, Wash.

[22] Filed: May 23, 1974

[21] Appl. No.: 472,640

[52] U.S. Cl. ..... 115/35; 115/41 R

[51] Int. Cl.[2] ..... B63H 5/12

[58] Field of Search ..... 115/41 R, 41 HT, 34 R, 115/34 A, 35, 37, 18 R; 114/66.5 H

[56] References Cited

UNITED STATES PATENTS

| | | | |
|---|---|---|---|
| 172,367 | 1/1876 | Allyn | 115/35 |
| 2,415,183 | 2/1947 | Law | 115/35 |
| 2,630,094 | 3/1953 | Hacker | 115/34 R |
| 2,856,883 | 10/1958 | Baker | 115/41 R |
| 3,057,320 | 10/1962 | Daniels | 115/35 |
| 3,270,699 | 9/1966 | Bush | 114/66.5 H |
| 3,368,516 | 2/1968 | MacDonald et al. | 115/35 |
| 3,430,603 | 3/1969 | Parish | 115/35 |
| 3,461,831 | 8/1969 | Lewis | 115/41 R |
| 3,626,467 | 12/1971 | Mazziotti | 115/41 HT |
| 3,841,257 | 10/1974 | Strang | 115/35 |

*Primary Examiner*—Trygve M. Blix
*Assistant Examiner*—Jesus D. Sotelo

[57] ABSTRACT

An exterior stern steering device for inboard motor boats to adjust not only the directional movement, but also the trim of the boat. The steering strut is pivotally connected to a swivel mounting to allow movement of the strut in both the vertical and lateral directions. A shaft housing in the strut contains the propeller shaft which is pivotally connected to the power transmission shaft by a constant velocity joint to provide a direct drive mechanism capable of the requisite maneuverability for allowing angular offset between the propeller shaft and the transmission shaft as the boat is propelled forward.

6 Claims, 8 Drawing Figures

STRUT DRIVE MECHANISM

BACKGROUND

This invention relates to the field of inboard power motor boats and more particularly to mechanisms to provide steering and trimming control of those boats. One of the more prevelant steering drive mechanisms used on present day inboard speed motor boats or pleasure boats is the inboard/outboard drive. This mechanism is comprised of a strut which is connected to the transmission drive of an engine through the use of a series of mechanical linkages, including conventional universal joints, two sets of 90° bevel gears, two to three shafts, two to three bearings and many other smaller parts. These inboard/outboard arrangements are designed to combine the advantages of utilizing a large powered engine set within the boat hull with the advantages of maneuverability in an outboard motor boat steering mechanism which provides the ability to maneuver the propeller itself, giving better steering response.

The primary disadvantage to those conventional inboard/outboard steering drives is the loss of power as a result of the use of the rather complicated connecting mechanism between the power transmission of the engine and the steering strut on which the propeller is mounted. The requirement to have the power transmission shaft make two 90° turns through two sets of bevel gears greatly contributes to the power loss which can be as much as 30% of potential power output from the engine. This can be of critical importance to inboard motor speed boats with regard to performance characteristics and also is of serious concern to fuel economy in pleasure boating.

Another reason for the use of an inboard/outboard stern drive mechanism is to place the engine to the stern of the boat in order to allow more space throughout the rest of the boat for other use. However, locating the engine at the stern of the boat presents a problem in the placement of the propeller drive shaft. Normally, when the engine is placed amid the boat, the extension of the propeller shaft to the stern of the boat provides a desirable low angle in the shaft. The low or small angle of the propeller drive shaft is necessary in order to produce the proper power thrust line for the boat for efficient movement through the water. However, the placement of the engine in the midsection of the boat is not conducive to pleasure boating, since the large power engine can be quite noisy and is situated in the middle of the living space. Consequently, various inboard/outboard drives or steering mechanisms were designed to enable the placement of the engine to the stern of the boat.

Some of the prior art inboard motor boats have utilized a pair of conventional universal joints to compensate for a higher angle for the propeller drive shaft. The problem with conventional U-joint systems is that the rotational velocity is not transmitted uniformly unless the transmission shaft and the propeller shaft are at zero offset. For any angular offset the output is a sinusoidal function with a complete acceleration and deacceleration for each turn of the shaft. The magnitude of these is determined by the angularity of the offset. Multiple installation of U-joints can compensate for parallel offsets between the power transmission shaft and the propeller shaft, but these cannot compensate for any angular offset. This becomes exceedingly important when considering the rotation of a system at higher velocity which spins at 7000 rpm or roughly a hundred times each second and the system has to bleed energy to accelerate and decelerate the mass involved. With the rotational inertias present, the system becomes non-rigid and elastic deformation of mechanical parts takes place. This then introduces the possibility of fatigue failure and in particular introduces another mechanical forcing function into a system which already has a similar frequency due to successive immersion of partially submerged propeller blades.

SUMMARY OF THE INVENTION

This invention discloses a strut drive mechanism comprising a strut member pivotally attached to the boat and a propeller shaft encased within the strut member which is pivotally mounted to the power drive shaft at a single joint, allowing for any variation of angular offset between the power transmission shaft and the propeller shaft. By eliminating the use of conventional universal joints and bevel gears, the power loss between the engine and the propeller is negligible.

The ability to maneuver the propeller shaft at various angular offsets allows for the precise trimming of the boat.

The connection between the power shaft and the propeller shaft is through the use of a constant velocity joint which provides for a smooth flow of power without any mismatch of rotational speeds and accompanying stresses to the mechanical systems. Therefore, one source of impulses is eliminated leaving only those introduced by the propeller blades as a result of their partial successive immersion.

The use of the single mechanical joint between the power shaft and the propeller shaft greatly increases the efficiency of the power transmittal and provides inboard speed boats the maximum forward movement for a given power input from the engine. In addition, in the case of pleasure boating, fuel economy is greatly enhanced, since power being produced from the engine is more efficiently transmitted to the propeller drive.

DETAILED DESCRIPTION OF THE INVENTION

Figure 1:
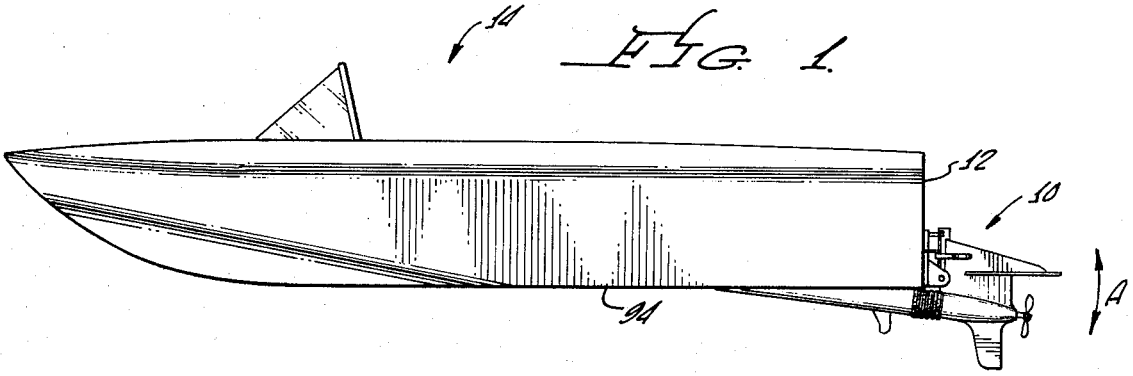
FIG. 1 is a side elevation view of the strut drive mechanism attached to an inboard motor boat.
Figure 5:
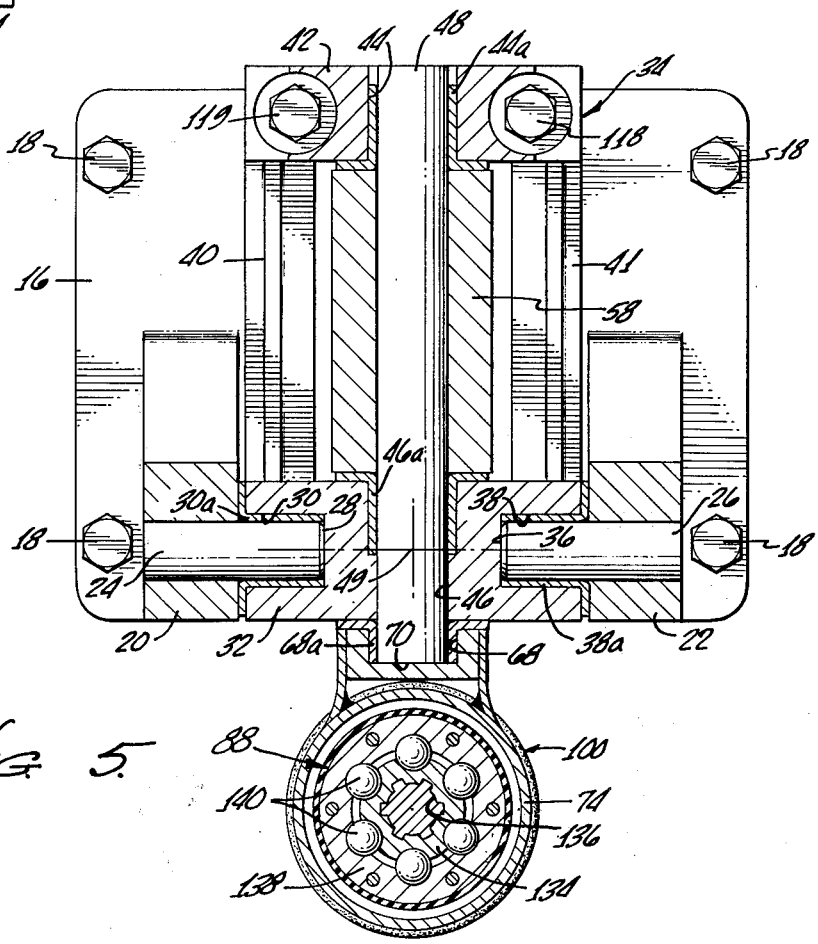
FIG. 5 is a sectional view taken along the lines 5—5 in FIG. 3.

Referring to FIG. 1 the strut drive mechanism 10 is shown attached to the stern 12 of the boat 14. The particular components of the strut drive mechanism 10 are shown more clearly in FIG. 2. A mounting plate 16 is used to mount the strut drive mechanism to the stern 12 of the boat 14 by the bolts 18. Extending to the rear of the mounting plate 16 are a pair of mounting flanges 20 and 22 which are used to support the respective horizontally aligned pivot shafts 24 and 26 as shown in FIG. 5. The inside end 28 of the shaft 24 extends into a cavity 30 located in the lower portion 32 of the swivel mounting 34 and the inside end 36 of the shaft 26 extends into a cavity 38 of the lower portion 32 of the swivel mounting 34. This allows the lower portion 32 of the swivel mounting to pivot on the mounting flanges 20 and 22 through a pitch arch A shown in FIG. 1.

Figure 2:
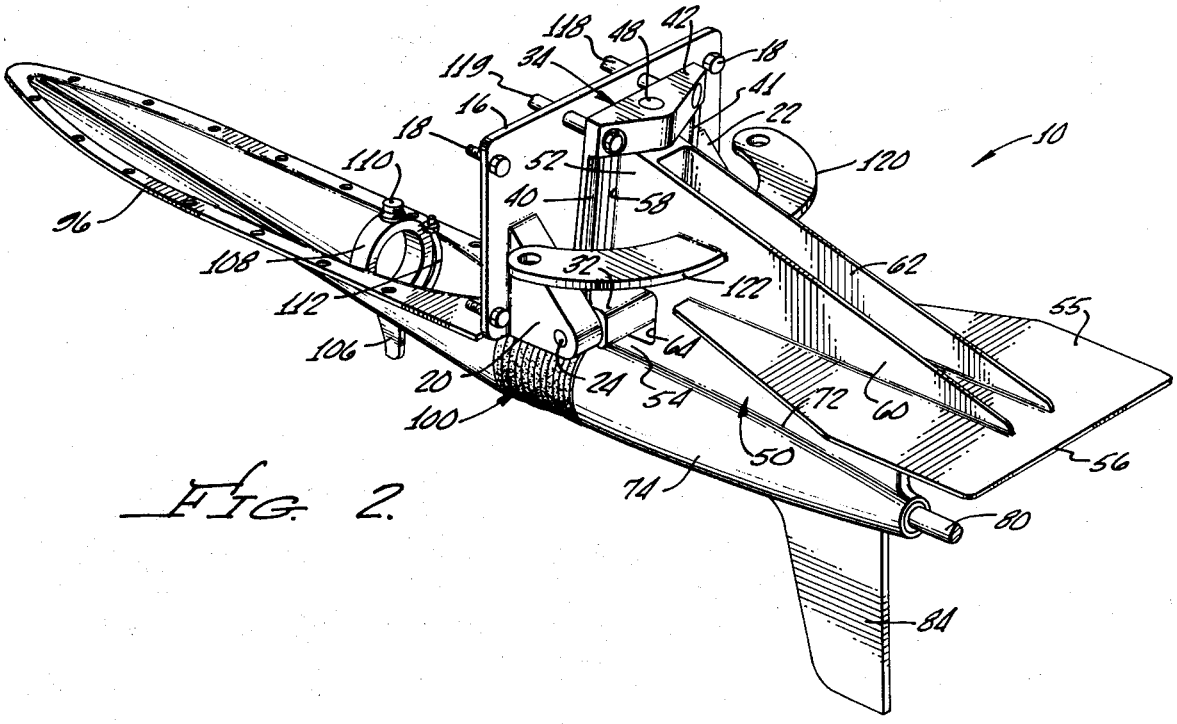
FIG. 2 is a perspective view of the invention detached from the inboard motor boat.

In FIG. 2 the swivel mounting 34 is comprised of two separated vertical supports 40 and 41 which connect an upper flange portion 42 and a lower flanged portion 32. Both the upper and the lower flange portions 42 and 32 extend further away from the mounting plate 16 than the vertical supports 40 and 41. With respect to FIG. 5, the upper flanged portion 42 has an aperture 44 while the lower flanged portion 32 has an aperture 46 which is in line with the aperture 44. Positioned within the aperture 44 and 46 is a vertical pivot shaft 48 which extends from the upper flange portion 42 down through the lower flange portion 32.

As shown in FIG. 2, mounted on the vertical pivot shaft 48 is a strut member having an upper portion 52 and a lower portion 54 separated by a cavitation plate 56. The forward end 58 of the upper portion 52 of the strut 50 is semi-cylindrical in shape and pivotally encloses the pivot shaft 48 between the two vertical supports 40 and 41 of the swivel mounting 34. This allows for clearance between the forward end 56 of the strut 50 and the swivel mounting when the strut moves in a lateral direction or around the vertical pivot shaft 48. Extending back to the rear of the leading edge 58 of the upper portion 52 of the strut 50 are a pair of angled flanges 60 and 62 which connect with the top 55 of cavitation plate 56. Located below the cavitation plate 56 is the lower portion 54 of the strut 50 having a cavity 64 to accommodate the lower portion 32 of the swivel mounting 34. With respect to FIG. 3, the forward end 66 of the lower portion 54 of the strut 50 below the cavity 64 has a semi-cylindrical shape which has a cylindrical aperture 68 to receive the lower end 70 of the vertical shaft 48. With respect to FIG. 4, the lower portion 54 of the strut 50 is comprised of two single plates 61 and 63, which extend back from the cavity 64 at a slight angle toward each other and connect in a semi-cylindrical joint 65. In reference to the above discussion, therefore, the strut 50 is capable of pivoting in a lateral direction about the vertical shaft 48 in the direction of the arrows B for steering of the boat.

Figure 3:
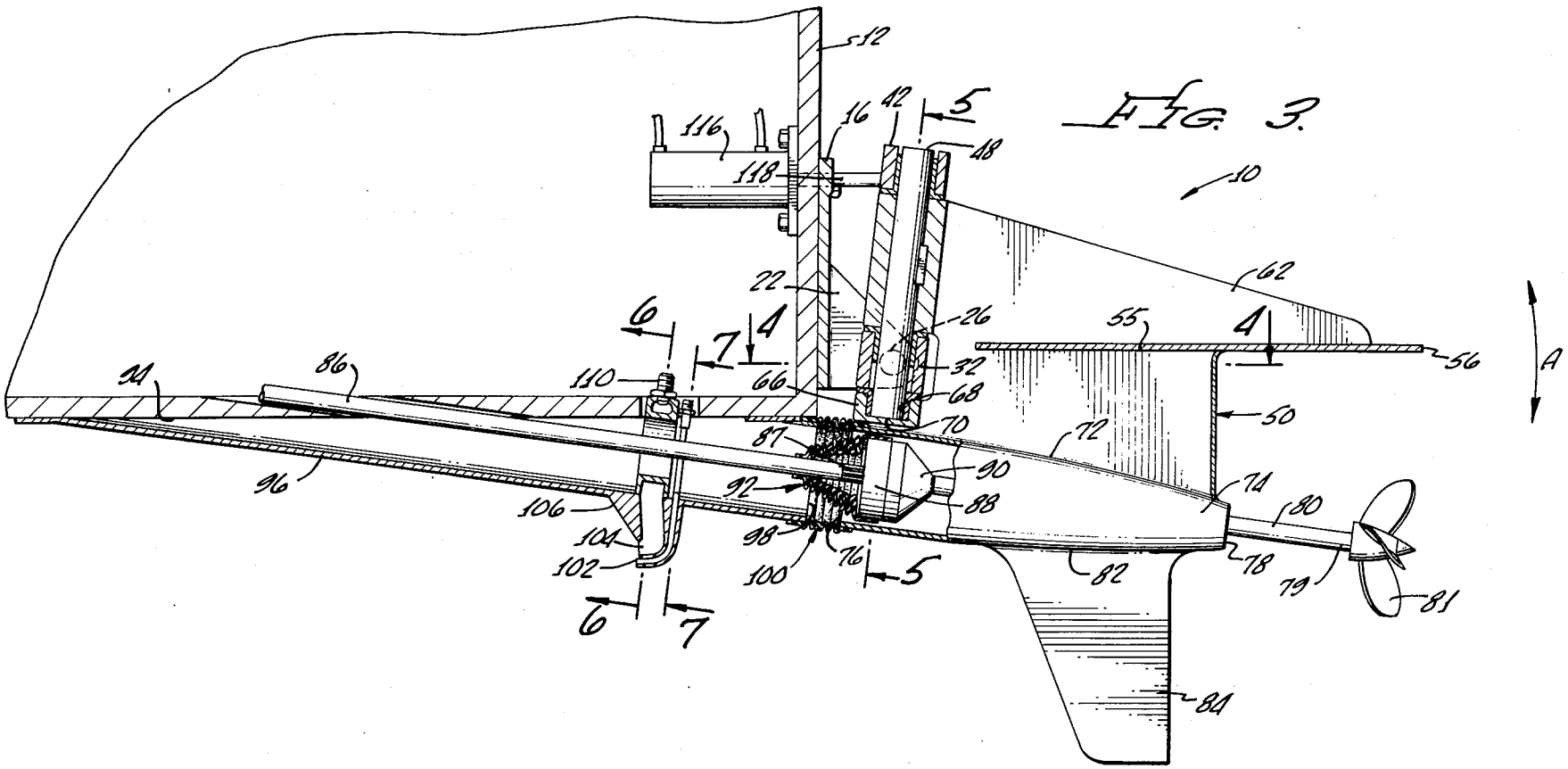
FIG. 3 is an enlarged partial sectional view of the strut drive mechanism attached to the stern of the boat.
Figure 4:
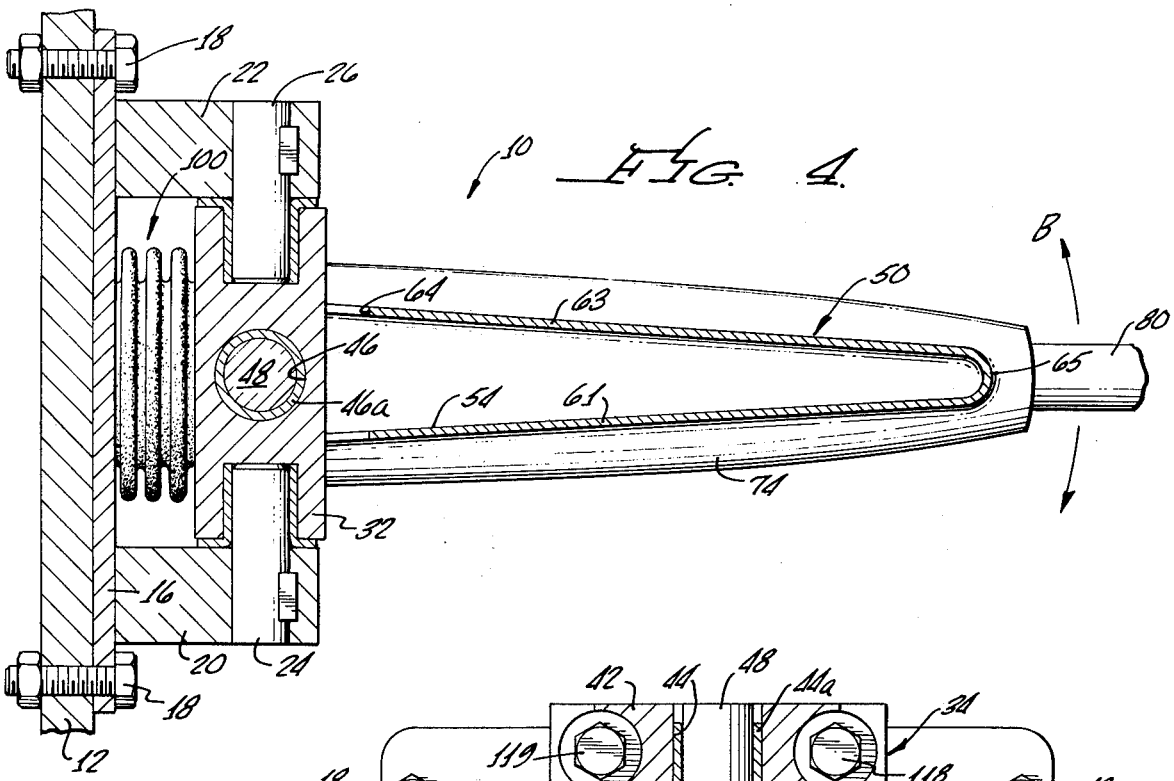
FIG. 4 is a sectional view taken along the lines 4—4 in FIG. 3.

In FIG. 3 mounted along the bottom edge 72 of the strut 50 is a propeller shaft housing 74 which is of a general cylindrical shape having a greater cross-sectional diameter at its forward end 76 than at its trailing end 78. The interior of the propeller shaft housing 74 is hollow in order to accommodate the propeller shaft 80. Connected to the lower portion 82 of the propeller shaft housing 74 is a skeg 84. Attached to the trailing end 79 of the propeller shaft is a propeller 81.

In order to connect the propeller shaft 80 with the power transmission shaft 86 from the boat, a constant velocity universal joint 88 is mounted within the forward end 76 of the propeller shaft housing 74 by a mounting bracket 90. An expandable interior sealing boot 92 is placed around the power transmission shaft 86 and over the constant velocity joint 88 in order to retain lubricating oil within the constant velocity joint.

Attached to the bottom 94 of the boat 14 is a fairing 96 which protects the power transmission shaft 86. The trailing edge 98 of the fairing 96 is aligned with and spaced from the forward end 76 of the propeller shaft housing 74. An expandable exterior sealing boot 100 is connected between the trailing edge 98 of the fairing 96 and the leading edge 76 of the propeller shaft housing 74 to protect the interior mechanism from outside water.

Figure 6:
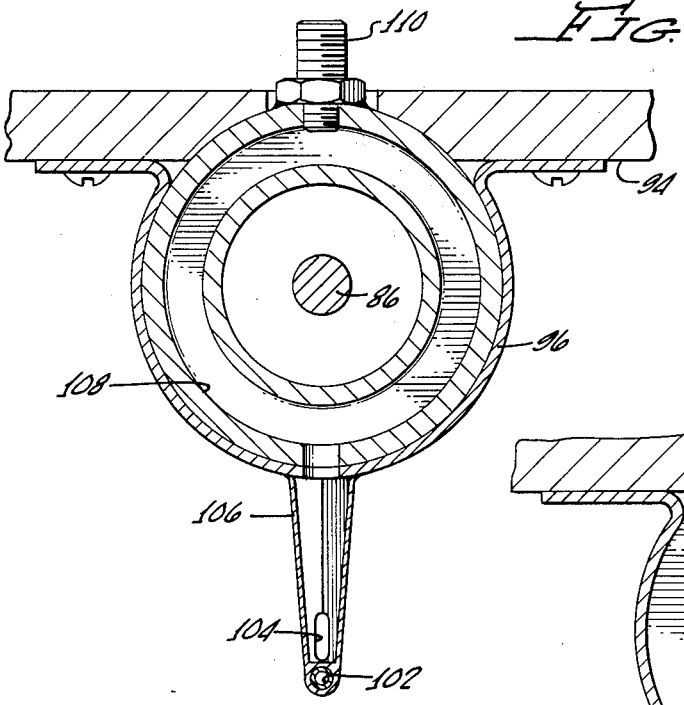
FIG. 6 is a sectional view taken along the lines 6—6 in FIG. 3.
Figure 7:
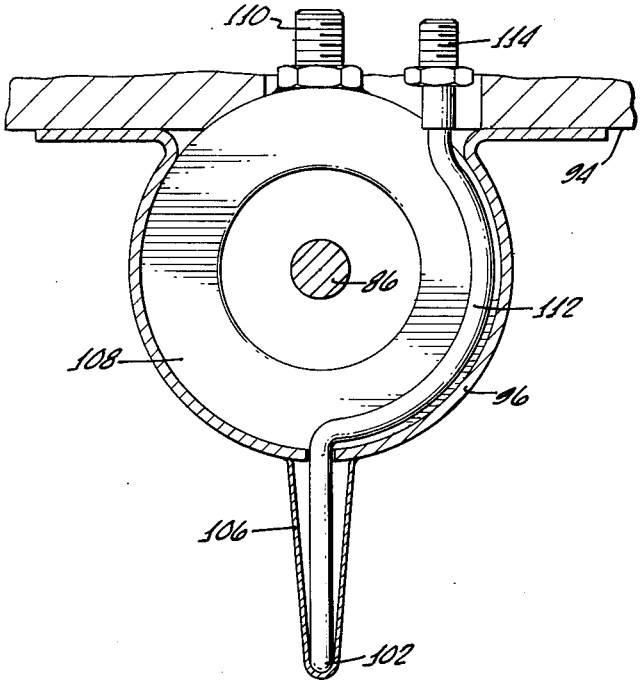
FIG. 7 is a sectional view taken along the lines 7—7 in FIG. 3.

Located within the fairing 86 are a pair of water intake ports 102 and 104 which are supported by a small vertical strut 106. Referring to FIG. 6, the intake port 104 directs the incoming water up to a circular tube 108 around the transmission shaft 86 and out through an outlet port 110 which leads to a cooling channel to cool the engine. Referring to FIG. 7 the inlet port 102 receives the incoming water and directs it up through a tube 112 around the transmission shaft 86 and to an outlet port 114 which leads to a speed indicator mechanism.

Referring to FIG. 3, a hydraulic mechanism 116 is mounted adjacent the stern 12 of the boat 14 with a hydraulic shaft 118 extending through the stern 12 of the boat and connecting onto the upper portion 42 of the swivel mounting 34. In FIG. 2, two hydraulic shafts 118 and 119 may be connected to the swivel mounting 34 and are used to control the pivotal movement of the swivel mounting through a pitch angle.

Figure 8:
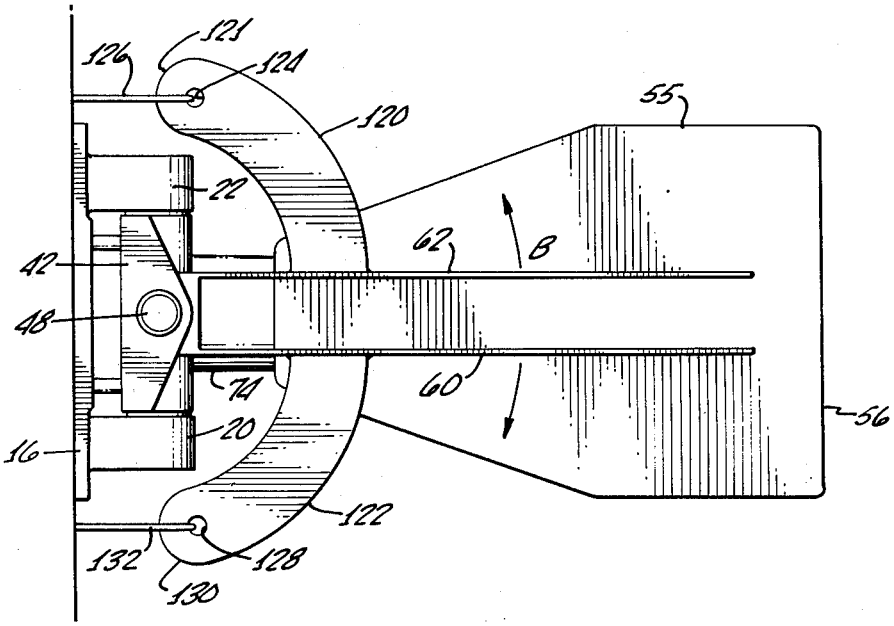
FIG. 8 is a top view of the strut drive mechanism.

As shown in FIG. 8, steering arms 120 and 122 are attached respectively to the flanges 62 and 60. At the forward end 121 of the arm 120 is located an aperture 124 to receive a steering rod 126. Similarly, an aperture 128 is located adjacent the forward end 130 of the arm 122 for connection to a steering rod 132. The steering rods 126 and 132 tie into a conventional racing type steering mechanism located within the boat. It should be recognized that several different type of steering mechanisms can be adapted for use with this strut drive mechanism. Instead of having the steering arms 120 and 122, a different steering take-off structure can be attached to the strut drive in a different place like on the swivel plate to accomplish the necessary steering requirements.

With respect to FIG. 5, it should be noted that within the apertures 30, 38, 44, 46 and 68 there are located respective bushings **30*a*, 38*a*, 44*a*, 46*a* and 68*a***.

The interior aspects of a constant velocity joint of the Rzeppa type for use with this invention are shown in FIG. 5 with an interior non-pivotal plate 134 having a splined aperture 136 to receive the power transmission shaft 86 with its splined trailing edge 87 (shown in FIG. 3). Again referring to FIG. 5, the outer plate 138 is attached to the propeller shaft 80 by the use of the mounting bracket 90 (shown in FIG. 3). Shown in FIG. 5 are the ball bearings 140 which allow the plate 138 to pivot at angular displacements from the plate 134. An exemplary constant velocity universal joint is marketed by the Industrial Products Division of Dana Corporation, Toledo, Ohio, under the trademark "Con-Vel."

Turning to the operation of the strut drive invention, reference is made to FIG. 3. In the operation of a boat there are two important control functions — trimming, which involves the angle of the propeller shaft, and steering, which concerns the movement of the vertical strut to direct the movement of the boat through the water. Considering first the trimming function, attention is directed to the swivel mounting with the upper flange 42 and the lower flange 32. As shown in FIG. 5, the swivel mounting 34 rotates about the horizontal shafts 24 and 26. Mounted within the swivel mounting 34 is the vertical shaft 48. Consequently, as the swivel mounting 34 pivots about the horizontal shafts 24 and 26, the strut member 50 as shown in FIG. 3 will pivot along with the swivel mounting in the directions of the arrow A. In conjunction with this movement of the strut 50, the propeller shaft housing 74 will also pivot in the directions of the arrow A. This in turn will cause the propeller shaft 80 itself to move in a similar direction. Because the power transmission shaft 86 is fixed with respect to any angular pivotal movement, the connection between the propeller shaft 80 and the power transmission shaft 86 must allow for this shaft or pitch angle produced by the movement of the swivel plate or mounting 34. The constant velocity joint 88 provides the means for allowing the vertical movement of the strut 50 with the propeller shaft 80. The expandable interior boot 92 and the expandable exterior boot 100 accommodate the movement between the pivoting propeller shaft housing 74 and the stationary fairing 96.

To provide the means for movement of the swivel mounting 34, the hydraulic mechanism 116 with its hydraulic shaft 118 will provide the necessary force and control in the movement of the strut 50 and the propeller shaft 80. By this movement through the use of the hydraulic mechanism 116, the operator of the boat will be able to quickly and easily change the shaft angle to control trimming without the use of a complicated mechanism which reduces the efficiency of power transmission from the engine in the boat to the propeller shaft.

With respect to the steering functions of the boat reference is made to FIGS. 2 and 8 which show the steering arms 120 and 122. The forward end 58 of the strut 50 is pivotally mounted on the vertical pivot shaft 48, so that, regardless of the pitch angle in the swivel mounting 34, the strut 50 is capable of pivoting in a lateral direction about the vertical shaft 48. This allows for the associated movement of the propeller shaft 80 in a lateral direction to guide the boat in the desired direction of the operator. Again, the power transmission shaft 86 as shown in FIG. 3 is stationary with respect to any angular movement and, therefore, the connection between the propeller shaft 80 and the power transmission shaft 86 must be able to accommodate any lateral angular movement of the power shaft 80. The constant velocity joint 88 provides the necessary ability to allow angular movement of the propeller shaft 80 when the strut 50 is turned in a lateral direction by the activation of the steering mechanism which is connected to the steering rods 126 and 132 in FIG. 8.

As a result of the above discussion on the operation of the strut drive invention for both trimming and steering of the boat, it should be readily apparent that the unique use of the constant velocity joint in this mechanism allows for the movement of the propeller shaft 80 to almost any offset angular position with respect to the power transmission shaft 86. In other words, regardless of the shaft angle as the result of trimming as shown in FIG. 3, the propeller shaft 80 is capable of any lateral movement as the result of movement in the direction of arrows B in FIG. 8. As viewed from the rear of the strut drive invention, the propeller can move to any number of positions located on a spherical sectional surface with a diameter established by the distance between the center point 49 of the shafts 48 and 24 and 26 shown in FIG. 5, and the trailing end 79 of the propeller shaft shown in FIG. 3 limited only by the mechanical ability of the swivel mounting 34 and the strut 50 as to the maximum angular movement of the propeller shaft in any direction.

Although the invention is shown connected to a power transmission shaft 86 coming out of the bottom 94 of the boat, it is envisioned that this invention would have equal applicability to a power transmission shaft coming directly out the stern 12 of the boat.

What is claimed is:

1. A steering unit for use on a power boat, said steering unit comprising:

means for attaching said unit to said boat;

a strut member;

means for rotatably mounting said strut member to said attaching means for movement of said strut member in a vertical direction;

means attached to said mounting means for rotatably connecting said strut member to said boat for movement of said strut member in a lateral direction;

a propeller shaft mounted adjacent said strut member;

a propeller attached to said propeller shaft;

a constant velocity universal joint connecting said propeller shaft to the power transmission shaft of said boat, said power transmission shaft extending from the bottom of said boat, said constant velocity universal joint allowing said propeller shaft to operate at an angular offset from said transmission shaft in response to any combination of movement of said strut about said mounting means and connecting means;

means for pivoting said propeller shaft vertically; and means for pivoting said propeller shaft laterally.

2. A steering unit for use on a power boat as described in claim 1 wherein said mounting means comprises:

a horizontal pivot shaft supported within said attaching means; and a swivel mounting rotatable on said horizontal pivot shaft, said strut member connected to said swivel mounting.

3. A steering unit for use on a power boat as described in claim 1 wherein said connecting means comprises a vertical shaft supported within said mounting means.

4. A power boat steering unit comprising:

means for pivotally mounting said unit to said boat;

a propeller shaft mounted adjacent said mounting means;

means for connecting said propeller shaft in line with the transmission shaft of said boat and for allowing said propeller shaft to pivot to an inclined position with respect to the transmission shaft while said boat is in operation;

a fairing to cover the exposed portions of said transmission shaft extending below said boat; and an inlet port extending below said fairing to receive water as said boat moves forward.

5. A power boat steering unit as described in claim 4 wherein said inlet port is connected to a flow channel leading to the engine of said boat, said inlet port and said channel receiving water and directing said water to said engine for cooling purposes.

6. A power boat steering unit as described in claim 4 wherein said inlet port is connected to a flow channel leading to a speed indicator in said boat, said inlet port and said channel receiving water and directing said water to said speed indicator for determination of the speed of said boat.

* * * * *